US009890621B2

(12) United States Patent
Bishop

(10) Patent No.: US 9,890,621 B2
(45) Date of Patent: Feb. 13, 2018

(54) TWO-PIECE PLUNGER

(71) Applicant: PCS FERGUSON, INC., Frederick, CO (US)

(72) Inventor: Wedith Bob Bishop, Whitehouse, TX (US)

(73) Assignee: PCS FERGUSON, INC., Frederick, CO (US)

( * ) Notice: Subject to any disclaimer, the term of this patent is extended or adjusted under 35 U.S.C. 154(b) by 0 days.

(21) Appl. No.: 14/877,222

(22) Filed: Oct. 7, 2015

(65) Prior Publication Data

US 2016/0097265 A1 Apr. 7, 2016

Related U.S. Application Data

(60) Provisional application No. 62/060,872, filed on Oct. 7, 2014.

(51) Int. Cl.

| | |
|---|---|
| ***E21B 43/00*** | (2006.01) |
| ***E21B 43/12*** | (2006.01) |
| ***E21B 47/00*** | (2012.01) |
| ***E21B 21/16*** | (2006.01) |
| ***E21B 21/00*** | (2006.01) |

(52) U.S. Cl.
CPC ..... *E21B 43/121* (2013.01)

(58) Field of Classification Search
None
See application file for complete search history.

(56) References Cited

U.S. PATENT DOCUMENTS

| | | | | |
|---|---|---|---|---|
| 2,001,012 A | | 5/1935 | Burgher | |
| 2,661,024 A | | 12/1953 | Knox | |
| 2,714,855 A | | 8/1955 | Brown | |
| 3,181,470 A | | 5/1965 | Clingman | |
| 3,209,872 A | | 10/1965 | Moyer et al. | |
| 3,329,211 A | * | 7/1967 | Roach | E21B 37/04 166/170 |
| 3,394,763 A | * | 7/1968 | Page, Jr. | E21B 37/04 15/104.18 |
| 4,502,843 A | | 3/1985 | Martin | |
| 4,528,896 A | * | 7/1985 | Edwards | E21B 37/10 166/202 |
| 5,333,684 A | | 8/1994 | Walter et al. | |
| 5,868,554 A | | 2/1999 | Giacomino | |

(Continued)

*Primary Examiner* — Matthew R Buck
*Assistant Examiner* — Douglas S Wood
(74) *Attorney, Agent, or Firm* — Russell T. Manning; Marsh Fischmann & Breyfogle LLP

(57) ABSTRACT

A two-piece well plunger is provided having an upper sleeve and a lower lance member that engages (e.g., unites) and disengages the upper member. The upper and lower member are sized for receipt within production tubing of a well and are configured to move upwardly in the production tubing when united and to fall separately when disengaged (e.g., separated). The upper sleeve is generally cylindrical and has an central bore. The lower lance member includes a dislodging rod that is sized to extend through central bore of the upper sleeve when the two pieces are united. The lance member and rod seal the central bore when the members are united. An upper end of the rod extends beyond a top end of the sleeve when the members are united and is utilized to disengage the members when the united plunger arrives in a well head.

19 Claims, 9 Drawing Sheets

(56) References Cited

U.S. PATENT DOCUMENTS 6,148,923 A 11/2000 Casey
6,209,637 B1 4/2001 Wells
6,241,028 B1 6/2001 Bijleveld et al.
6,273,690 B1 8/2001 Fischer, Jr. et al.
6,467,541 B1 10/2002 Wells
6,591,737 B2 7/2003 Giacomino
6,669,449 B2 12/2003 Giacomino
6,705,404 B2 3/2004 Bosley
6,719,060 B1 4/2004 Wells
6,725,916 B2 * 4/2004 Gray ..... E21B 43/121 166/101
6,746,213 B2 6/2004 Giacomino
6,883,612 B2 4/2005 Ferguson
6,907,926 B2 6/2005 Bosley
6,935,427 B1 8/2005 Billingsley
6,945,762 B2 9/2005 Williams
7,290,602 B2 * 11/2007 Victor ..... E21B 17/1071 166/105
7,314,080 B2 * 1/2008 Giacomino ..... E21B 34/14 166/105
7,383,878 B1 * 6/2008 Victor ..... E21B 43/121 166/105
7,475,731 B2 * 1/2009 Victor ..... E21B 43/121 166/105
7,597,143 B2 * 10/2009 Giacomino ..... E21B 43/121 166/105
8,122,962 B2 * 2/2012 Croteau ..... E21B 43/124 166/105
8,181,706 B2 5/2012 Tanton
8,347,955 B1 * 1/2013 Sewell ..... E21B 43/121 166/105
8,485,263 B2 7/2013 Lembcke
9,109,424 B2 * 8/2015 Jefferies ..... E21B 34/08
2003/0141051 A1 7/2003 Abbott et al.
2003/0155129 A1 8/2003 Gray et al.
2003/0215337 A1 11/2003 Lee
2004/0129428 A1 7/2004 Kelley
2012/0132437 A1 5/2012 Gong et al.

* cited by examiner

TWO-PIECE PLUNGER

CROSS REFERENCE

The present application claims the benefit of the filing date of U.S. Provisional Application No. 62/060,872 having the filing date of Oct. 7, 2014, the entire contents of which is incorporated herein by reference.

FIELD

The present disclosure relates to a plunger lift apparatus for lifting of formation liquids in a hydrocarbon well. More specifically the disclosure is directed to a two-piece plunger that separates at a well surface allowing each piece to descend into a well separately and unite at a well bottom, upon which the united plunger raises to the surface.

BACKGROUND

A plunger lift is an apparatus that can be used to increase the productivity of oil and gas wells. In the early stages of a well's life, liquid loading may not be a problem. When production rates are high, well liquids are typically carried out of the well tubing by high velocity gas. As a well declines and production decreases, a critical velocity is reached wherein heavier liquids may not make it to the surface and start falling back to the bottom of the well exerting pressure on the formation, thus loading up the well. As a result, the gas being produced by the formation can no longer carry the liquid being produced to the surface. As gas flow rate and pressures decline in a well, lifting efficiency can decline substantially.

Well loading typically occurs for two reasons. First, as liquid comes in contact with the wall of the production string of tubing, friction slows the velocity of the liquid. Some of the liquid may adhere to the tubing wall, creating a film of liquid on the tubing wall which does not reach the surface. Second, as the liquid velocity continues to slow, the gas phase may no longer be able to support liquid in either a slug form or a droplet form. Along with the liquid film on the sides of the tubing, a slug or droplet(s) may begin to fall back to the bottom of the well. In an advanced situation there will be liquid accumulated in the bottom of the well. The produced gas must bubble through the liquid at the bottom of the well and then flow to the surface. However, as gas advances through the accumulated liquid, the gas may proceed at a low velocity. Thus, little liquid, if any, may be carried to the surface by the gas, resulting in only a small amount of gas being produced at the surface.

A plunger lift system can act to remove accumulated liquid in a well. That is, a plunger lift may unload a gas well and, in some instances, unload the gas well without interrupting production. A plunger lift system utilizes gas present within the well as a system driver. A plunger lift system works by cycling a plunger into and out of the well. During a cycle, a plunger typically descends to the bottom of a well passing through fluids within the well. Once the liquids are above the plunger, these liquids may be picked up or lifted by the plunger and brought to the surface, thus removing most or all liquids in the production tubing. The gas below the plunger will push both the plunger and the liquid on top of the plunger to the surface completing the plunger cycle. As liquid is removed from the tubing bore, an otherwise impeded volume of gas can begin to flow from a producing well. The plunger can also keep the tubing free of paraffin, salt or scale build-up.

In certain wells, fluid buildup hampers the decent of the plunger to the well bottom. Thus, wells with a high fluid level (e.g., high gas flow rates and/or high liquid accumulations) tend to lessen well production by increasing the cycle time of the plunger lift system, specifically by increasing the plunger descent time to the well bottom. Prior art designs have utilized two-piece plungers having a ball and sleeve arrangement to reduce decent time to the well bottom. Typically, the ball portion of the plunger is received in a lower end of a hollow sleeve portion of the plunger wherein the ball and sleeve unite at the well bottom. Once united, the ball is disposed in a lower opening of the sleeve and prevents fluid passage there through. At this time, gas beneath the united two-piece plunger accumulates and raises the plunger through the well. Further, the gas pressure beneath the united plunger maintains the ball within the lower opening of the sleeve. At the surface, the united two-piece plunger is received in a lubricator where an extracting rod passes through the sleeve and dislodges the ball. The ball is then free to fall to the bottom of the well. The sleeve is typically held in the lubricator for a time by flow from the well or by mechanical engagement. Once released, the sleeve falls to the well bottom where it unites with the ball.

While ball and sleeve plunger improve the cycle time in high flow wells, these ball and sleeve plungers provide little benefit once flow of the well decreases. That is, such ball and sleeve plungers are primarily utilized for the first few months of a well's production. After this time, multiple alternate plungers (e.g., by-pass, one-piece) may be utilized with the reduced flow rates. However, changing from a ball and sleeve plunger to another plunger type typically requires reconfiguring the lubricator to remove the extraction rod that is necessary for use with a ball and sleeve plunger.

SUMMARY

Provided herein, is a two-piece plunger that may be utilized with a standard lubricator free of an extraction rod. The two-piece plunger provides the benefit of reducing cycle time in high flow wells while allowing a user to replace the two-piece plunger at a later time without having to reconfigure the lubricator.

According to one aspect, a two-piece plunger is provided having an upper sleeve or upper member and a lower lance or lower member that engages (e.g., unites) and disengages the upper member. The upper and lower member are sized for receipt within production tubing of a well and are configured to move upwardly in the production tubing when united and to fall separately when disengaged (e.g., separated). The upper sleeve is generally cylindrical and has an open top end, an open bottom end and an internal or central bore extending there between. The internal bore provides a fluid path through the upper sleeve when the upper sleeve is not engaged by the lower member. The lower lance member includes a dislodging rod that is sized to extend through internal bore of the upper sleeve when the two pieces are united. More specifically, a tip or upper end of the rod extends beyond a top end of the sleeve when the members are united. The lower member also includes a body connected to a lower end of the rod. The body has one or more internal and/or external flow paths that allow fluid to flow across the body when the body is disposed within the production tubing and when the lower member is disengaged from the upper member. When united, fluid flow (e.g., gas flow) is substantially prevented across the united plunger. That is, the lower lance member plugs the upper sleeve when these members are united to substantially prevent gas flow across the united plunger. This allows gas below the united plunger to move the plunger upward in a well. In addition, formation fluid above the plunger are lifted to the surface. When these members are separated at the surface, fluid is able to flow across and/or through each member allowing these members to descend into the production tubing of the well against fluid flow.

The size and weight of the two members may be varied to provide desired properties to the plunger. For instance, the internal diameter of the central bore of the upper sleeve maybe sized to provide a desired descent rate. Accordingly, the diameter of the rod of the lower member may be correspondingly sized. Further, the bore may be sized to maintain the upper sleeve within a lubricator using fluid flow through the lubricator (i.e., free of mechanical capture). In this regard, the internal bore may include a reduced diameter section. However this is not a requirement. In a further arrangement, a mechanical catcher may engage the sleeve when the sleeve is in the lubricator.

Further, the materials forming the upper and lower pieces may be varied and the two pieces may use common or different materials. For instance, the lower member may be formed of titanium while the upper member is formed of steel (e.g., stainless steel).

DETAILED DESCRIPTION

Reference will now be made to the accompanying drawings, which at least assist in illustrating the various pertinent features of the presented inventions. The following description is presented for purposes of illustration and description and is not intended to limit the inventions to the forms disclosed herein. Consequently, variations and modifications commensurate with the following teachings, and skill and knowledge of the relevant art, are within the scope of the presented inventions. The embodiments described herein are further intended to explain the best modes known of practicing the inventions and to enable others skilled in the art to utilize the inventions in such, or other embodiments and with various modifications required by the particular application(s) or use(s) of the presented inventions.

Figure 1:
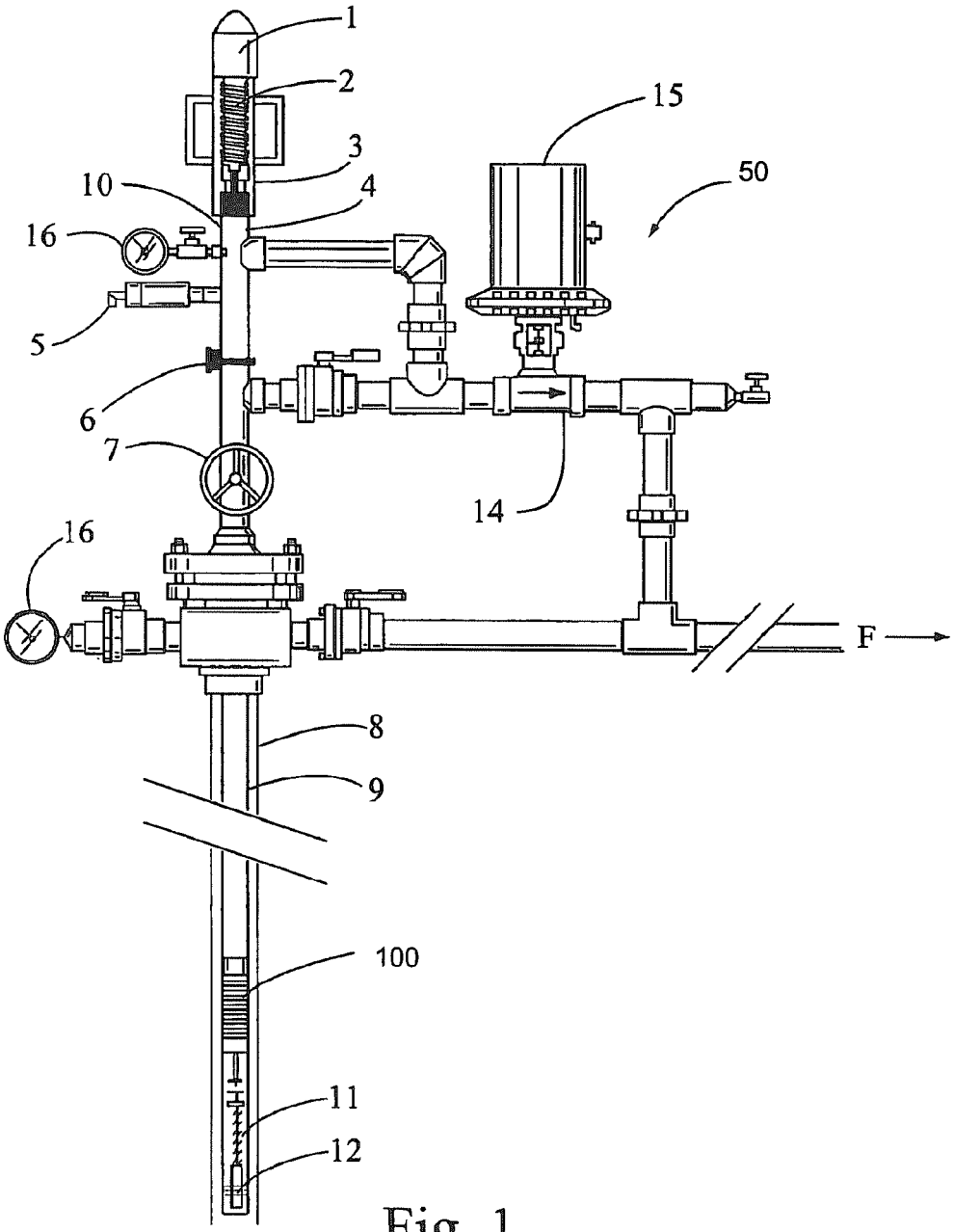
FIG. 1 illustrates an exemplary plunger lift system installation.

A typical installation plunger lift system 50 can be seen in FIG. 1. The system includes what is termed a lubricator assembly 10 disposed on the surface above a well bore including casing 8 and production tubing 9. The lubricator assembly 10 is operative to receive a plunger 100 from the production tubing 9 and release the plunger 100 into the production tubing 9 to remove fluids (e.g., liquids) from the well. Fluid accumulating above of the plunger 100 at the bottom of the well may be carried to the top of the well by the plunger 100. Specifically, after passing though the liquids at the bottom of the well, gasses accumulate under the plunger lifting the plunger and the fluid accumulated above the plunger to the surface. The plunger 100 can represent the plunger of the presented inventions or other prior art plungers. In any arrangement, the lubricator assembly 10 controls the cycling of the plunger into and out of the well. The lubricator assembly 10 includes a cap 1, integral top bumper spring 2, striking pad 3, and a receiving tube 4, which is aligned with the production tubing.

In some embodiments, the lubricator assembly 10 contains a plunger auto catching device 5 and/or a plunger sensing device 6. The sensing device 6 sends a signal to surface controller 15 upon plunger 100 arrival at the top of the well and/or dispatch of the plunger 100 into the well. When utilized, the output of the sensing device 6 may be used as a programming input to achieve the desired well production, flow times and wellhead operating pressures. A master valve 7 allows for opening and closing the well. Typically, the master valve 7 has a full bore opening equal to the production tubing 9 size to allow passage of the plunger 100 there through. The bottom of the well is typically equipped with a seating nipple/tubing stop 12. A spring standing valve/bottom hole bumper assembly 11 may also be located near the tubing bottom. The bumper spring is located above the standing valve and can be manufactured as an integral part of the standing valve or as a separate component of the plunger system.

Surface control equipment usually consists of motor valve(s) 14, sensors 6, pressure recorders 16, etc., and an electronic controller 15 which opens and closes the well at the surface. Well flow 'F' proceeds downstream when surface controller 15 opens well head flow valves. Controllers operate based on time, or pressure, to open or close the surface valves based on operator-determined requirements for production. Alternatively, controllers may fully automate the production process.

When motor valve 14 opens the well to the sales line (not shown) or to atmosphere, the volume of gas stored in the casing and the formation during the shut-in time typically pushes both the fluid load and the plunger 100 up to the surface. Forces which exert a downward pressure on a plunger can comprise the combined weight of the fluid above the plunger, the plunger itself as well as the operating pressure of the sales line together with atmospheric pressure. Forces which exert an upward pressure on a plunger can comprise the pressure exerted by the gas in the casing. Frictional forces can also affect a plunger's movement. For example, once a plunger begins moving to the surface, friction between the tubing and the fluid load opposes plunger movement. Friction between the gas and tubing also slows an expansion of the gas. However, in a plunger installation, generally it is only the pressure and volume of gas in the tubing and/or casing annulus which serves as the motive force for bringing the fluid load and plunger to the surface. Once received at the surface, the plunger may be immediately dispatched back into the well or held until a subsequent plunger cycle time.

Figure 2A:
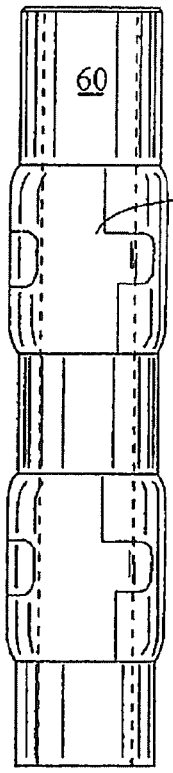
FIGS. 2A-2D illustrate plan views of exemplary sidewall geometries for a plunger.
Figure 2B:
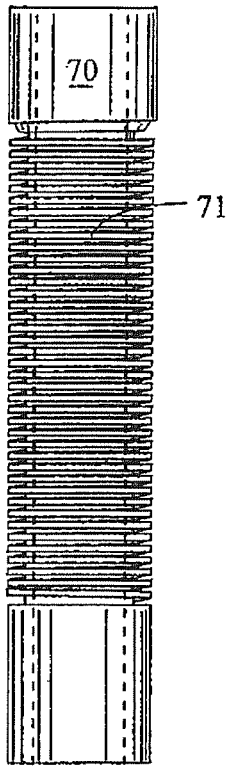
Figure 2C:
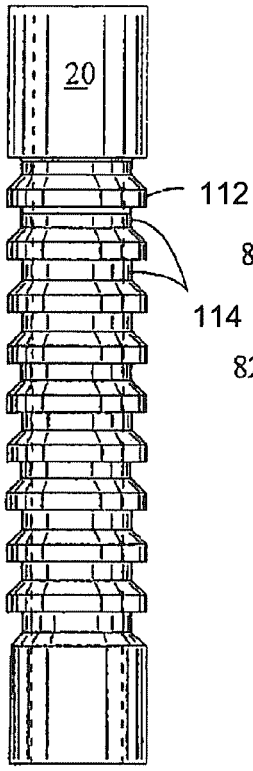
Figure 2D:
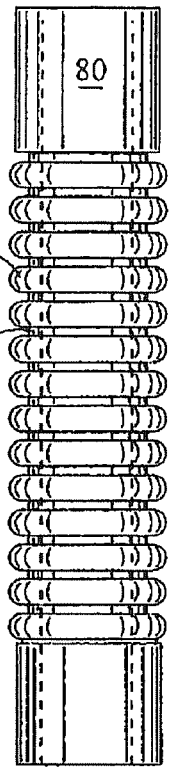

Plungers can be designed with various sidewall or sleeve geometries. Some examples are set forth in FIGS. 2A through 2D, any of these sidewall geometries may be utilized with the upper sleeve portion and/or the lower lance portion as discussed below. In FIG. 2A, a pad plunger sleeve 60 is shown having spring-loaded interlocking pads 61 in one or more sections. The interlocking pads 61 expand and contract to compensate for any irregularities in the tubing, thus creating a tight friction seal. In FIG. 2B, a brush plunger sleeve 70 is shown that incorporates a spiral-wound, flexible nylon brush 71 surface to create a seal and allow the plunger to travel despite the presence of sand, coal fines, tubing irregularities, etc. FIG. 2C shows a plunger sleeve 110 with a solid ring 112 sidewall geometry where the rings are sized to create a seal with the interior surface of production tubing. Solid sidewall rings 112 can be made of various materials such as steel, poly materials, Teflon™, stainless steel, etc. Inner cut groves 114 allow sidewall debris to accumulate when a plunger is rising or falling. FIG. 2D shows a shifting ring plunger 80 with a shifting ring 81 sidewall geometry. The sidewall geometry of shifting rings 81 allow for continuous contact against the tubing to produce an effective seal with wiping action to ensure that all scale, salt or paraffin is removed from the tubing wall. Shifting rings 81 are all individually separated at each upper surface and lower surface by air gap 82. Snake plungers (not shown) are flexible for coiled tubing and directional holes, and can be used as well in straight standard tubing.

Figure 3B:
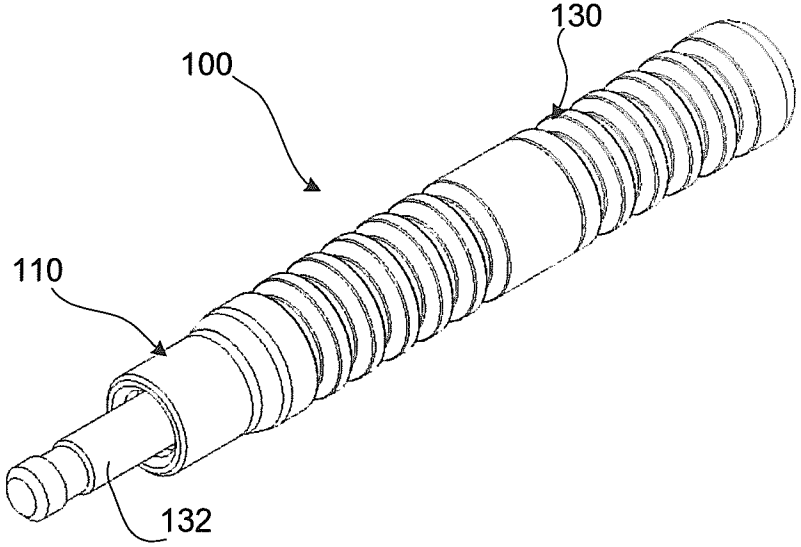
FIGS. 3A and 3B illustrate a first embodiment of two-piece plunger separated and united, respectively.
Figure 3A:
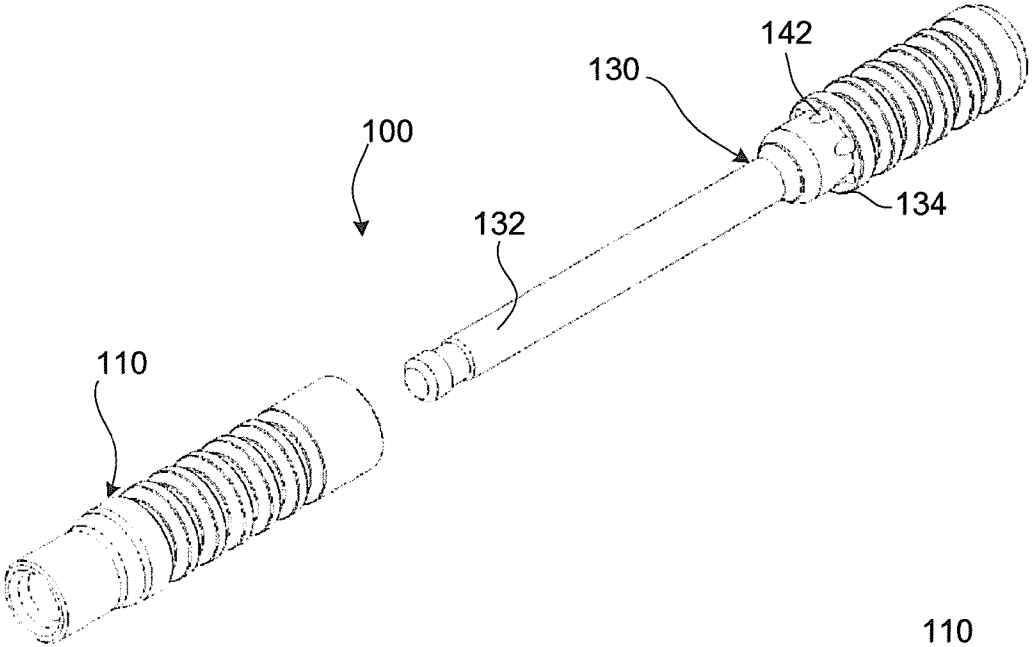
Figure 4A:
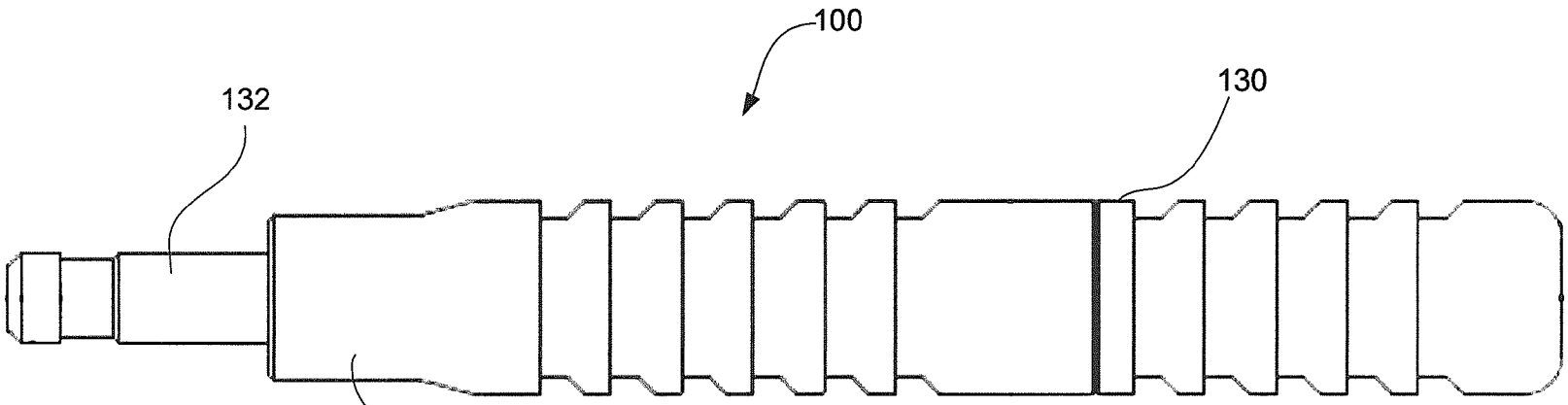
FIG. 4A illustrate a plan view of the two-piece plunger of FIGS. 3A and 3B united.
Figure 4B:
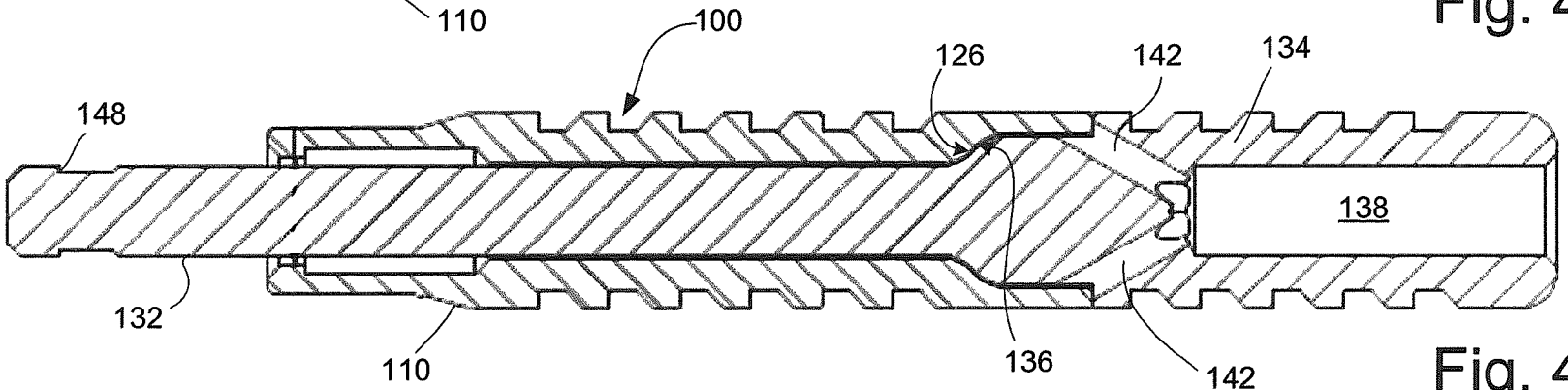
FIGS. 4B and 4C illustrate cross-sectional views of two-piece plunger of FIGS. 3A and 3B united and separated, respectively.
Figure 4C:
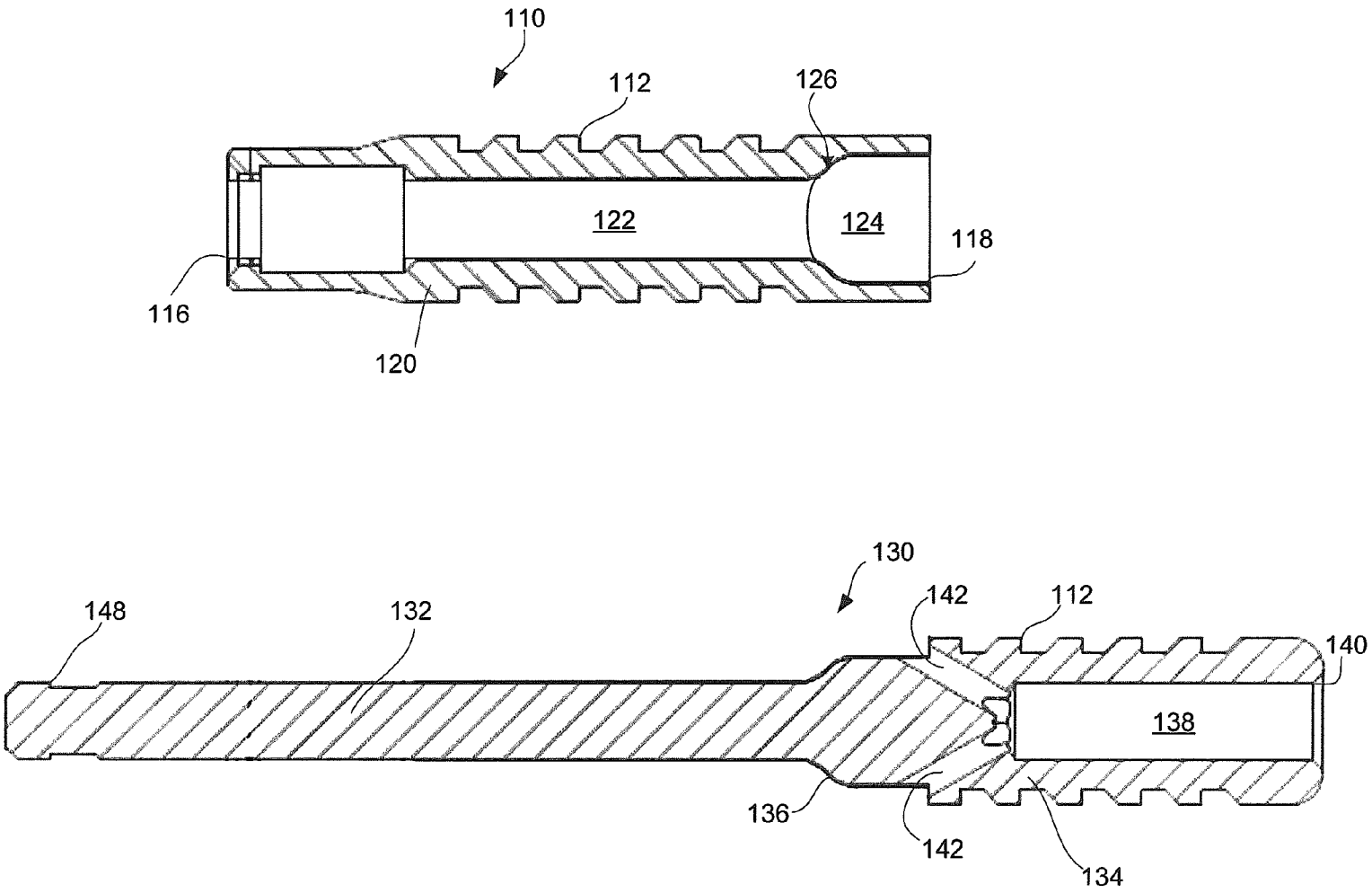

FIGS. 3A and 3B illustrate a perspective view of one embodiment of a two-piece plunger 100 separated and united, respectively. FIGS. 4A, 4B and 4C illustrate side plan, cross-sectional united, and a cross-sectional separated views, respectively, of the two-piece plunger 100 of FIGS. 3A and 3B. As shown, the present embodiment of the two piece plunger 100 includes an upper sleeve member 110 and a lower lance member 130. In the illustrated embodiment, outside surfaces of both the upper and lower members have the solid ring sidewall geometry as described in FIG. 2C. However, it will be appreciated that these members 110, 130 may incorporate any sidewall geometry. As shown, the lower lance member 130 has an elongated lance or rod 132 that extends through the interior of the upper sleeve member 110. When separated, fluid is able to flow through or across each of these members 110, 130. When the upper and lower members are united, fluid is prevented from flowing across the united plunger 100 allowing gas below the plunger to lift the plunger to the surface, as will be more fully discussed herein.

As best shown in FIGS. 4B and 4C, the sleeve member 110 is generally cylindrical having an open top end 116, an open bottom end 118 and a continuous sidewall 120 extending there between. That is, the sleeve 110 is generally a hollow tube having an internal or central bore 122 that extends between the open bottom end 118 and the open top end 116. At least a portion of the outside diameter of the sleeve member 110 is sized for substantial conformal receipt within production tubing of a well. The sleeve diameter may vary for differently sized production tubes. The open bottom end 118 further includes an end bore or socket 124 that is aligned with a central axis of the internal bore 122 of the sleeve. As shown, the end bore 124 has a diameter that is greater than the diameter of the internal bore 122. A transition between the end bore 124 and central bore 122 forms a shoulder or seat 126, which provides a stop or contact surface that engages a mating shoulder 136 of the lance member 130, when the two-piece plunger is united as shown in FIG. 4B. When the shoulder 136 of the lance member 130 is in contact with the seat 126, fluid flow across the plunger is substantially prevented.

As noted above, the lance member 130 includes an elongated rod 132 that is sized to extend through the central bore 122 of the sleeve member 110 when these members are united. In the illustrated embodiment, an upper end of the rod 132 comprises a standard American Petroleum Institute (API) fishing neck 148 design. When the upper and lower members are united, the fishing neck 148 extends beyond the top end of the sleeve member 110. If retrieval is required, a spring-loaded retriever is lowered into production tubing, falls over the API internal fishing and catches beneath a recessed annular landing of the fishing neck 148. This allows retrieving of the plunger if, and when, necessary. As the fishing neck 148 extends through and beyond the top end of the sleeve member 110 when the members are united, such retrieval allows for retrieving both members of the two-piece plunger 100.

The rod 130 is connected to an upper end of a body 134 of the lower lance member 130. The rod 132 has an outside cross-dimension/diameter that is sized to fit though the internal bore 122 of the sleeve 110 whereas the body 134 has a larger outside cross-dimension/diameter, which is sized to fit within a production tubing. A transition between the rod diameter and body diameter forms the shoulder 136, which is sized for conformal receipt within the end bore/socket 124 of the sleeve and against the sleeve seat 126. The rod 132 has a length that is greater than the length of the sleeve 110. In this regard, the rod extends out of the top open end 116 of the sleeve 110 when the sleeve and lance members are united. This permits both retrieval of the plunger using the fishing neck as described above and use of the top end of the rod 132 to disengage the sleeve 110 and lance member 130 upon the arrival of the united plunger in a surface unit/lubricator, as is more fully discussed herein.

In the illustrated embodiment, the body 134 of the lance member 130 also includes an internal bore 138, which extends from a bottom open end 140 upward into the body 134. In the present embodiment, an upper portion of the body 134 proximate to the shoulder 136 includes a plurality of ports 142. In the illustrated embodiment, the upper portion of the body sleeve includes six annular ports 142 disposed about its periphery. Other embodiments may use more or fewer ports. Further, such ports may have other geometrical configurations. The ports extend from the internal bore 138 to an outside surface of the body 134. In the illustrated embodiment, these ports 142 open through the shoulder 136 of the lance member 130. These ports 142 permit fluid to flow though the body 134, when the ports 142 are unimpeded. The ports 142 are impeded/closed when the lance member 130 is united with the sleeve member 110. That is, uniting the upper and lower members of the plunger results in the ports 142 being disposed within the end bore 124 of the sleeve member 110. That is, a solid sidewall of the end bore 124 blocks the ports 142 when the sleeve and lance members are united preventing fluid flow through the internal bore 138 and ports 142 of the lance portion 130.

Figure 5A:
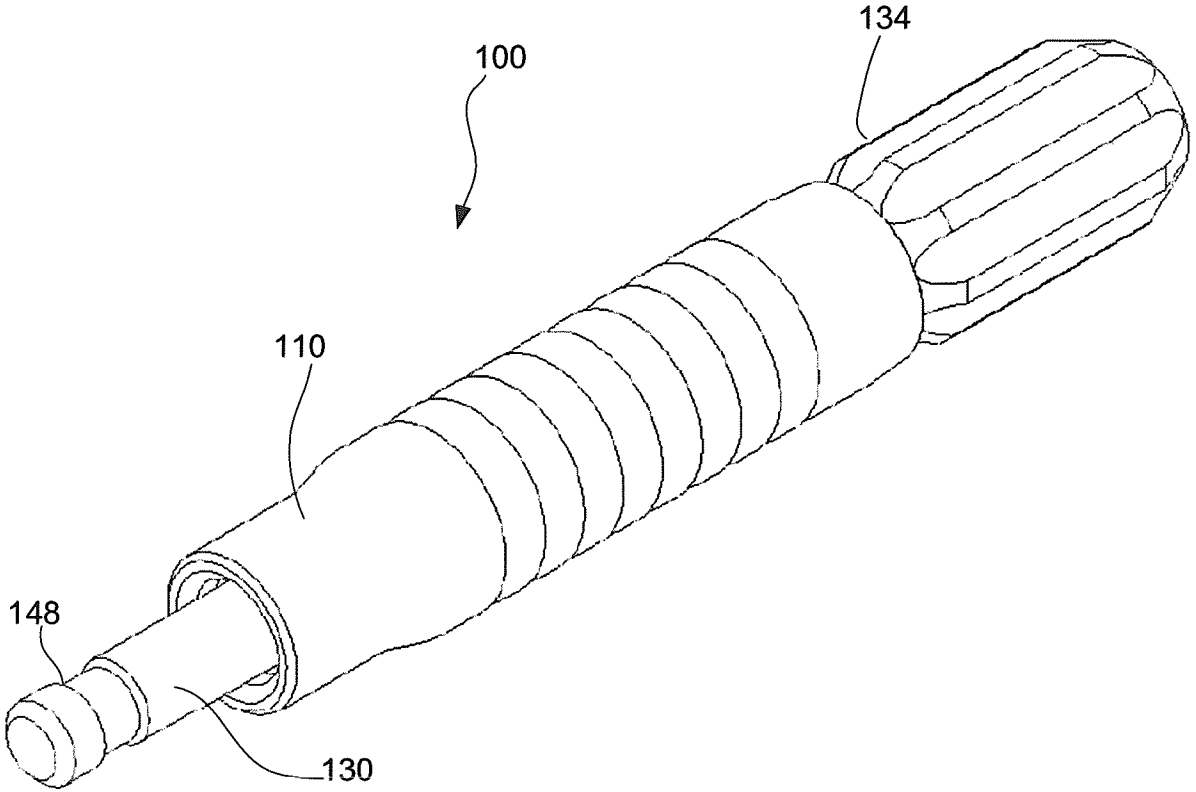
FIGS. 5A and 5B illustrate a second embodiment of two-piece plunger separated and united, respectively.
Figure 5B:
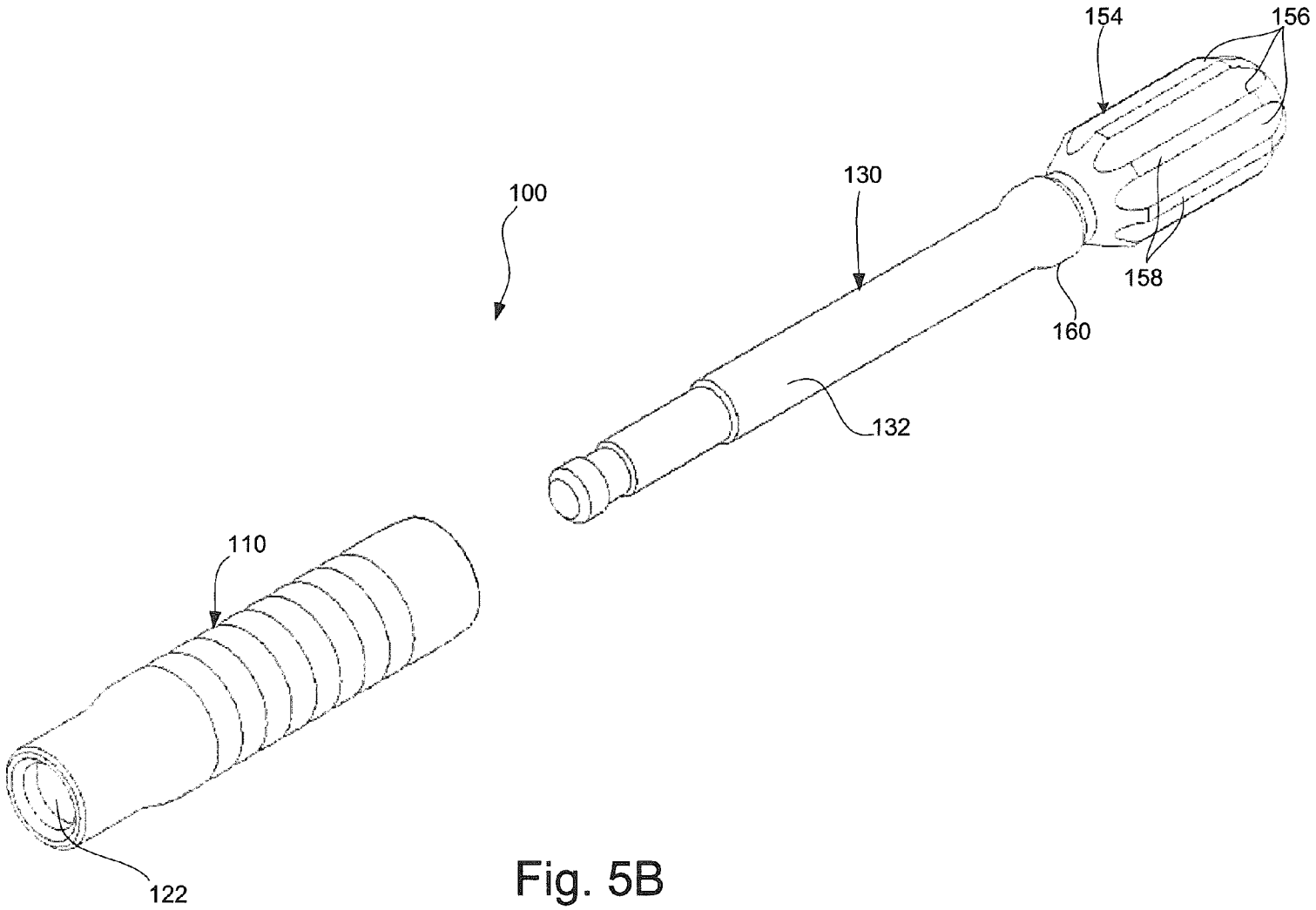
Figures 6A, 6B, 6C, 6D, 6E, 6F:
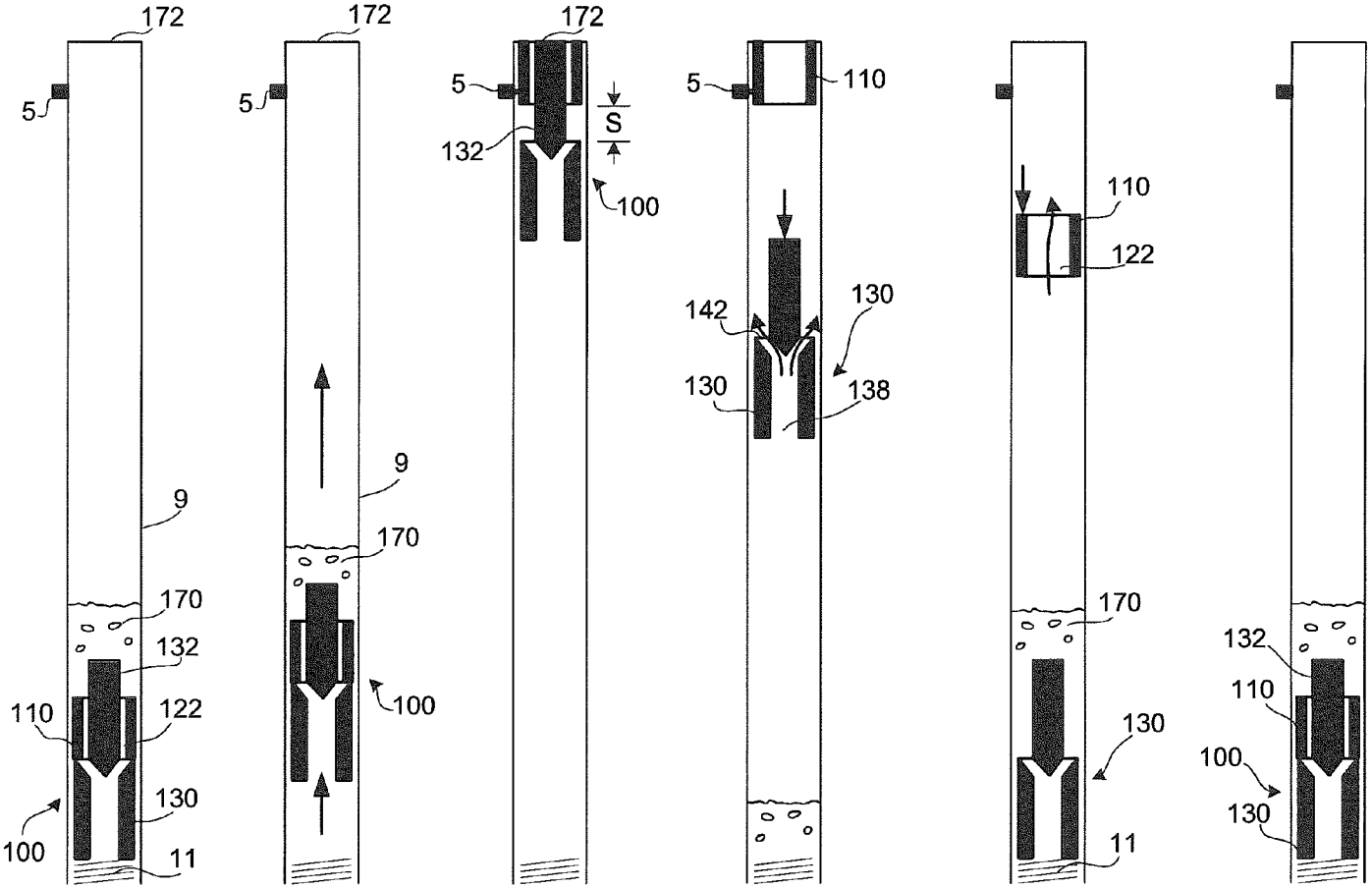
FIGS. 6A-6F illustrates a plunger cycle where the two-piece plunger is united at a well bottom, ascends when united, separates into two pieces at the well surface, lower member descends into the well, upper member descends into the well, and unites the two pieces at the bottom of the well, respectively.

FIGS. 5A and 5B illustrate another embodiment of a two-piece plunger 100. Specifically, FIG. 5A illustrates the plunger united and FIG. 5B illustrates the plunger separated. As shown, this embodiment of the plunger 100 again includes a sleeve member 110 and a lance member 130. As illustrated, the sleeve member 110 is substantially identical to the sleeve member of FIGS. 3A-4C. In contrast, the lance member 130 allows for fluid to flow around the lance member (i.e., when the sleeve member and lance member are separated) as opposed to flowing through an internal bore and ports as illustrated in the embodiment of FIGS. 3A-4C. As with the previous embodiment, the lance member 130 of FIGS. 5A and 5B includes an elongated rod 132 sized to extend through a central bore of the sleeve member 110 and having an upper end that includes a fishing neck 148. A lower end of the rod 132 connects to a body 154, which has a plurality of axial recesses 156 that extend from a bottom surface of the body to an upper end of the body. The axial recesses 156 define a plurality of axial vanes 158 there between. The axial recesses 156 provide flow channels that permit fluid to flow across the lance member 130 when the lance member is separated from the sleeve member 110. The number and sizes of these recesses 156 may be varied to provide a desired decent rate for the lance member 130. Further, an outside diameter of the body 154 of the lance member 130 defined by the axial vanes 158 is typically sixed to provide substantially conformal receipt within a production tubing.

In the embodiment of FIGS. 5A and 5B, the lance member includes an annular shoulder 160 that is formed near a lower end of the rod 132. This annular shoulder 160 has a diameter that is larger than the diameter of the rod 132 and central bore 122 of the sleeve member 110. As with the prior embodiment, the annular shoulder 160 is sized to matingly engage a seat in the bottom open end of the sleeve member (not shown). When the annular shoulder 160 engages the seat in the sleeve member (i.e., the lance member and sleeve member are united) fluid flow across the united plunger is substantially prevented.

FIGS. 6A-6F show cross-sectional views of the plunger embodiment of FIGS. 3A-4C disposed within production tubing 9 and illustrate a full plunger cycle where the plunger ascends and descends in a well. Though illustrates as utilizing the first embodiment of the plunger, it will be appreciated that the following discussion applies to the plunger embodiment of FIGS. 5A and 5B as well. As shown, the upper sleeve member 100 and lower lance member 130 begin the cycle united at the bottom of the well at a spring standing valve/bottom hole bumper assembly 11. See FIG. 6A. The rod 132 is disposed through the internal bore 122 of the sleeve 110 such that the shoulder of the lance member 130 is disposed in the end bore of the sleeve 110. This seals the central bore 122 of the sleeve member 110 substantially preventing fluid flow across the united plunger 100. The united portions of the plunger 100 are then pushed upward in the tubing 9 string by the pressure of the gas flowing from the formation and accumulating below the plunger. See FIG. 6B. Accumulated liquid 170 above the plunger 100 is pushed upward above the sleeve 110 until it reaches the surface and is produced through the well head (not shown).

When the united plunger 100 reaches the surface and enters the well head, the tip or top end of the rod 132 contacts an end surface 172 in the lubricator. See FIG. 6C. This contact stops the movement of the lance member 130. However, momentum of the sleeve 110 allows the sleeve 110 to continue upward after the tip of the rod 130 contacts the end surface 172 of the lubricator. This separates the shoulder of the lance member from the seat in the bottom end of the sleeve. A mechanical catching device 5 may engage the sleeve 110 after it separates from the lower portion 130. At this time, there is a space 'S' between the sleeve 110 and lower lance member 130. This separation exposes the ports 142 of the lance member 130 such that gases below the sleeve member 130 can flow through or across the lance member. As gases are able to flow through or past the lance member 130, the lance member 130 then falls/descends toward the bottom of the well. See FIG. 6D. In the illustrated embodiment, the formation gases flow though the internal bore 138 and ports 142 of the lance member 130 as it descends. After a period of time, the lance member descends through accumulated liquid 170 at the bottom of the well and comes to rest on a bumper spring or other bottom hole device 11.

To allow the lower portion 130 to reach the bottom of the well first, the sleeve 110 may be held for a time in the lubricator. After a predetermined time, the sleeve is released (e.g., by disengaging the mechanical catcher) to allow the sleeve 110 to fall out of the lubricator and to the bottom of the well. The duration that the sleeve 110 is maintained in the lubricator may permit the lance member enough time to reach the well bottom prior to release of the sleeve member. Alternatively, the sleeve member may be released prior to the lance member reaching the well bottom. In any embodiment, it is desirable that the sleeve and lance do not unite prior to both reaching the well bottom. Along these lines, the sleeve and lance member may be designed such that they fall at desired decent rates. For instance, the sleeve may be designed to descend at a slower rate than the lance member. In any embodiment, gas flows upwardly through the internal bore 122 of the sleeve 110 during its descent. See FIG. 6E. When the sleeve 110 reaches the bottom of the well, it passes through any accumulated liquids 170 and unites with the lance member 130. That is, the rod 132 and sleeve 110 reunite, sealing the central bore of the sleeve substantially preventing fluid flow across the united plunger. See FIG. 6F. The cycle begins anew as the pressure of the upwardly flowing formation gas pushes the united plunger upwardly in the production tubing. See FIG. 6A.

Figure 7:
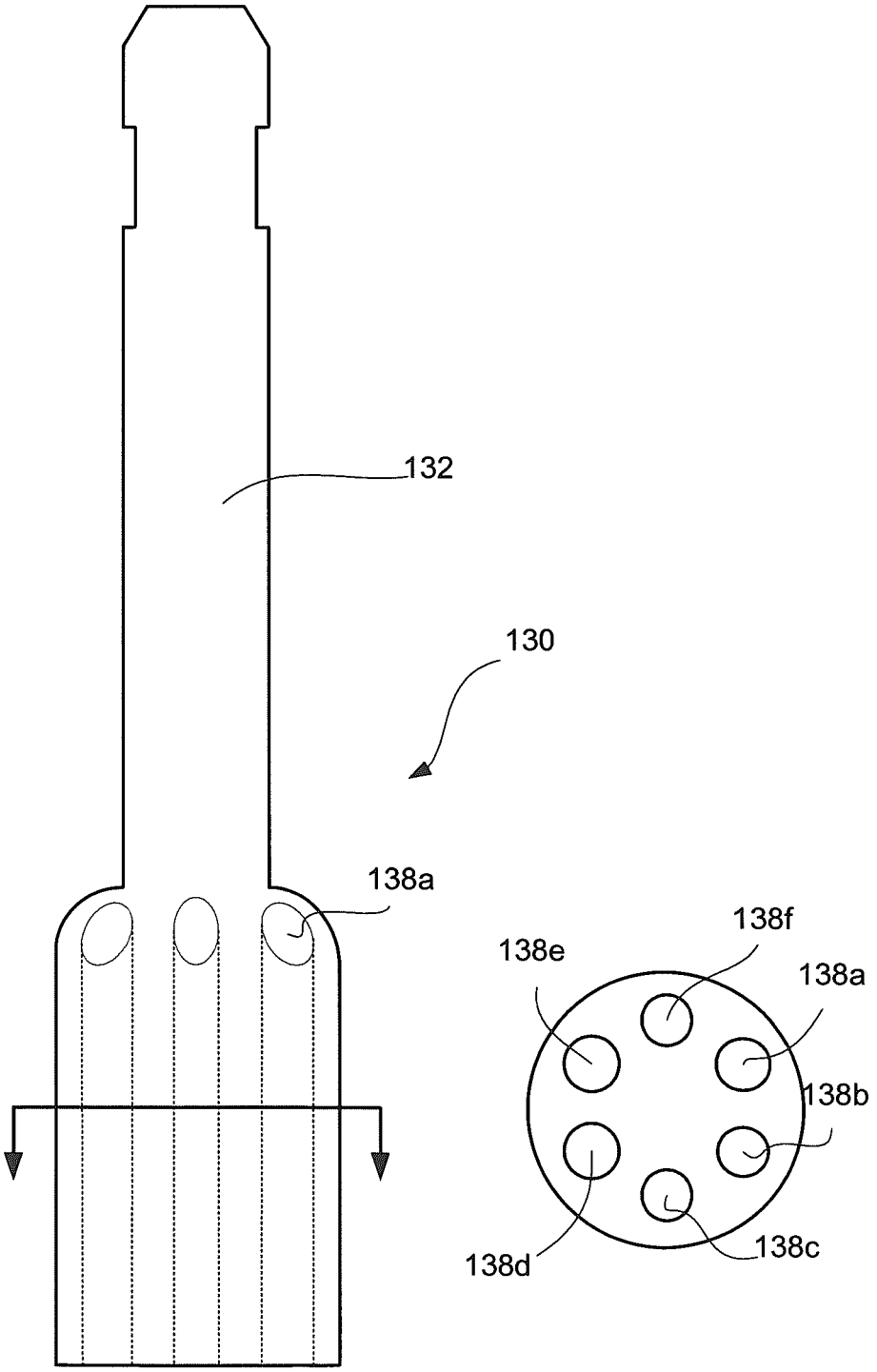
FIG. 7 illustrates a further embodiment of the lower member of a two-piece plunger.

It will be appreciated that multiple variations of the two piece plunger are possible and within the scope of the presented inventions. For instance, the rod of the lower portion may include a small axial (e.g., central) aperture that allows gas beneath the lower member to pass through the plunger thereby aerating fluid above the plunger similar to that disclosed in U.S. Pat. No. 7,513,301. Alternatively, the body of the lance member 130 may incorporate a plurality of individual bores of external channels rather than an internal bore. See FIG. 7. In such an embodiment, the number and spacing of the bores may vary.

The foregoing description has been presented for purposes of illustration and description. Furthermore, the description is not intended to limit the inventions and/or aspects of the inventions to the forms disclosed herein. Consequently, variations and modifications commensurate with the above teachings, and skill and knowledge of the relevant art, are within the scope of the presented inventions. The embodiments described hereinabove are further intended to explain best modes known of practicing the inventions and to enable others skilled in the art to utilize the inventions in such, or other embodiments and with various modifications required by the particular application(s) or use(s) of the presented inventions. It is intended that the appended claims be construed to include alternative embodiments to the extent permitted by the prior art.

What is claimed is:

1. A plunger for use in a production well comprising:

a cylindrical upper member having a central bore extending between an open bottom end and an open top end, wherein an outside diameter of said upper member is sized for receipt within a production tubing;

a lower member having:

a rod having a maximum cross dimension between an upper end of said rod and a lower end of said rod that is less than a minimum bore diameter of said central bore, wherein said rod is configured for receipt within said central bore and extension through said open top end of said central bore of said upper member;

a body connected to said lower end of said rod, said body having an outside diameter larger than said minimum bore diameter and sized for receipt in the production tubing; and a port passing through said body and having an inlet proximate to a lower portion of said body and an outlet proximate to a connection point between said body and said rod;

wherein said upper member and said lower member are configured to:

unite, wherein said rod extends through said central bore and said upper end of said rod extends beyond said open top end of said upper member and fluid flow through said central bore is substantially blocked by said lower member; and disengage, wherein said rod is disposed entirely outside said central bore.

2. The device of claim 1, wherein said open bottom end further comprises a socket having a socket diameter greater than a bore diameter of said central bore, wherein a transition between said socket diameter and said bore diameter defines an annular seat.

3. The device of claim 2, wherein said lower member comprises:

an annular shoulder surface formed at a transition between said rod and said body, wherein said annular shoulder surface is sized for conformal receipt against said annular seat when said upper member and said lower member unite.

4. The device of claim 2, wherein said socket is sized to receive an upper portion of said body when said upper member and said lower member unite and said rod is disposed though said central bore.

5. The device of claim 1, wherein said body of said lower member further comprises:

an internal bore extending axially from a bottom end of said body though a portion of said body, wherein said inlet of said port is in fluid communication with said internal bore.

6. The device of claim 5, wherein said outlet of said port is disposed within said socket when said upper member and said lower member unite, wherein a sidewall of said socket at least partially covers said outlet of said port.

7. The device of claim 1, wherein said body further comprises:

a plurality of ports passing through said body, each of said plurality of ports having an inlet proximate to said lower portion of said body and an outlet proximate to said connection point between said body and said rod.

8. The device of claim 1, wherein said upper end of said rod further comprises a fishing neck, wherein said fishing neck extends beyond said open top end of said upper member when said upper member and said lower member unite.

9. The device of claim 2, wherein said outlet of said port extends through said annular shoulder surface.

10. A method for use in a gas well, comprising:

uniting a two-piece plunger at a subterranean location in a production tubing of a well, wherein a rod connected to a lower member of said plunger extends through an internal bore of an upper member of said plunger and extends beyond a top end of the upper member, wherein uniting said lower member and said upper member blocks a flow path through said lower member and prevents gases below said plunger from flowing through the united upper member and lower member;

receiving the united upper member and lower member of the plunger at a surface unit;

stopping upward movement of said lower member when an end of said rod contacts a surface in said surface unit;

permitting momentum of said upper member to continue upward movement of said upper member after upward movement of the lower member stops to at least partially separate said upper member from said lower member permitting gas flow through said flow path through said lower member;

maintaining the upper member within the surface unit; and allowing the lower member to descend into the production tubing of the well wherein fluid passes through said flow path of said lower member while the upper member is maintained in the surface unit.

11. The method of claim 10, further comprising:

releasing the upper member to allow the upper member to descend into the production tubing of the well.

12. The method of claim 11, wherein said releasing the upper member is performed at a predetermined time after the lower member begins descending into the production tubing.

13. The method of claim 10, wherein said allowing the lower member to descend into the production tubing occurs while gas is flowing upwardly in the production tubing.

14. The method of claim 10, wherein said receiving comprises:

moving the united upper member and lower member of the two-piece plunger upward in the production tubing using gas pressure below the united upper member and lower member.

15. The method of claim 10, further comprising:

in conjunction with uniting said upper member and said lower member, displacing accumulated formation liquids at the subterranean location in the production tubing to a location above the two-piece plunger.

16. The method of claim 10, wherein said at least partially separating said upper member from said lower member comprises moving a surface of said lower member from a seat surface of said upper member.

17. The method of claim 10, wherein said at least partially separating said upper member from said lower member comprises dislodging said lower member from a socket in said upper member.

18. A plunger for use in a production well comprising:

a cylindrical upper member having a central bore extending between an open bottom end and an open top end, wherein an outside diameter of said upper member is sized for receipt within a production tubing;

a lower member having:

a rod having a maximum cross dimension between an upper end of said rod and a lower end of said rod that is less than a minimum bore diameter of said central bore, wherein said rod is configured for receipt within said central bore and extension through said open top end of said central bore of said upper member;

a body connected to said lower end of said rod, said body having an outside diameter larger than said minimum bore diameter and sized for receipt in the production tubing; and at least one recess on an outside surface of said body and extending from a location proximate to a bottom end of said body to a location proximate to a connection point between said body and said rod, wherein said upper member and lower member are configured to:

unite, wherein said rod extends through said central bore and said upper end of said rod extends beyond said open top end of said upper member and fluid flow through said central bore is substantially blocked by said lower member; and disengage, wherein said rod is disposed entirely outside said central bore, wherein said recess permits fluid to flow by said body when said lower member is separated from said upper member.

19. The device of claim 18, wherein said body further comprises:

a plurality of recesses, wherein said recesses are equally spaced about a circumference of said body.

* * * * *